US005325013A

United States Patent [19]

Johnson et al.

[11] Patent Number: 5,325,013

[45] Date of Patent: Jun. 28, 1994

[54] CATHODE-RAY TUBE WITH IMPROVED ELECTRON GUN

[75] Inventors: Jeffrey P. Johnson, Lawrenceville; David A. New, Mercerville, both of N.J.

[73] Assignee: RCA Thomson Licensing Corporation, Princeton, N.J.

[21] Appl. No.: 937,780

[22] Filed: Sep. 1, 1992

[51] Int. Cl.[5] ..... H01J 29/50; H01J 29/46; H01J 29/56; H01J 29/58

[52] U.S. Cl. ..... 313/413; 313/414; 313/412; 315/382; 315/15

[58] Field of Search ..... 313/413, 414, 412, 449, 313/460; 315/382, 15

[56] References Cited

U.S. PATENT DOCUMENTS

| | | | |
|---|---|---|---|
| 4,468,587 | 8/1984 | Sluyterman | 313/413 |
| 4,935,663 | 6/1990 | Shimoma et al. | 313/412 |
| 5,061,881 | 10/1991 | Suzuki et al. | 315/382 |
| 5,157,130 | 10/1992 | Tominaga et al. | 313/412 |
| 5,241,240 | 8/1993 | Chen et al. | 313/412 |
| 5,281,892 | 1/1994 | Kweon et al. | 313/414 |

OTHER PUBLICATIONS

SID 1992 Digest, 45.2-"A New Method of Designing a DQL Trinitron Gun to Reduce the Dynamic Focus Voltage", by Y. Iguchi et al., pp. 881-884, Sony Corp., Atsugi, Japan.

Paper presented at IDRC 1991, "Double-Quadrupole DAF For Self-Converging Color CRTS", by H. Suzuki et al., Matsushita Electronics Corp., Osaka, Japan; 1991 IEEE, pp. 31-34.

*Primary Examiner*—Donald J. Yusko
*Assistant Examiner*—Matthew J. Esserman
*Attorney, Agent, or Firm*—Joseph S. Tripoli; Dennis H. Irlbeck

[57] ABSTRACT

An improved cathode-ray tube includes a viewing screen and an electron gun for generating and directing three electron beams toward the screen. The gun includes at least eight electrodes spaced in order from three cathodes, with the furthest electrode from the cathodes being interconnected to a tube anode. The electrodes form a beam forming region, a first quadrupole lens, a main focus lens and a second quadrupole lens in the path of each electron beam. In the improvement, the second quadrupole lens is positioned on the anode side of main focus lens, with the first quadrupole lens being diverging for defocusing the beams, and the second quadrupole lens being converging for focusing the beams in the horizontal plane.

4 Claims, 4 Drawing Sheets

CATHODE-RAY TUBE WITH IMPROVED ELECTRON GUN

The present invention relates to cathode-ray tubes (CRT's) having electron guns therein, and particularly such a tube having an electron gun with two quadrupole lenses in the path of each electron beam.

BACKGROUND OF THE INVENTION

Among the more important factors that limit the performance of high-resolution CRT's, such as those required for high-definition television (HDTV), are the enlargement and distortion of an electron beam spot on the tube screen when the beam is deflected away from the center of the screen. Demands for improved CRT's with higher resolution, smaller high-current spots, and flatter faceplates have led to numerous attempts to reduce spot growth and distortion, primarily by minimizing the effects of deflection defocusing caused by the yoke.

Systems that use a self-convergent yoke and an electrostatic stigmator have been developed to eliminate the vertical overfocusing and flare that degrade high-resolution images. However, these systems produce focused electron beam spots, at full horizontal deflection on the screen, that are about twice as wide as the spot at the screen center and therefore are unacceptable for high-resolution CRT's.

Substantial reductions in electron beam spot width at the screen can be achieved in self-convergent systems by the application of two quadrupole lenses, called quadrupole-doublets. These lenses may be either magnetic or electrostatic. Spot width at the screen periphery can be reduced when the two quadrupole lenses are oriented so that the divergent plane of the first quadrupole lens traversed by the beam, and the convergent plane of the second quadrupole lens traversed by the beam, are in the horizontal plane of each of the tube and yoke.

Electrostatic quadrupole doublets are advantageous because they do not affect beam convergence at the screen in multibeam displays. Beam separation at the deflection plane also is not affected by the electrostatic quadrupole doublets, so there is no change required in either the shadow mask contour or in the mask-to-screen spacing within a tube.

One application of an electrostatic quadrupole doublet to reduce spot growth and achieve equal horizontal and vertical spot magnification is disclosed in U.S. Pat. 5,061,881, issued to Suzuki et al., on Oct. 29, 1991. That patent discloses the use of two astigmatic lens fields, one in the beam-forming region and the other located near the main focus lens, on the side of the main focus lens facing the beam-forming region. However, it has been found that placement of both astigmatic lenses between the cathodes and the main focus lens has only a limited capacity for reducing spot growth. Computer simulations, at low beam currents (0.5 to 1 mA), indicate that reductions of less than 20% in spot width can be achieved with this lens arrangement. At higher beam currents, the ability of this lens arrangement to reduce spot width decreases; and for currents above 2 mA, actually increases spot width. The simulations also indicate that the spot correction provided by the lens arrangement is limited by the spherical aberration of the main focus lens. Therefore, the computer simulations have shown that, if the main focus lens is optimally filled with an electron beam, locating a quadrupole doublet before the main focus lens can only degrade spot size at the screen, and that spot uniformity can only be improved at the expense of increased spot size at the center of the screen.

SUMMARY OF THE INVENTION

An improved cathode-ray tube includes a viewing screen and an electron gun for generating and directing three electron beams toward the screen. The tube includes a horizontal axis, a vertical axis and a longitudinal axis. A horizontal plane of said tube includes the horizontal and longitudinal axes. The gun includes at least eight electrodes spaced in order from three cathodes, with the furthest electrode from the cathodes being interconnected to a tube anode. The plurality of electrodes form a beam forming region, a first quadrupole lens, a main focus lens and a second quadrupole lens in the path of each electron beam. In the improvement, the second quadrupole lens is positioned on the anode side of the main focus lens, with the first quadrupole lens being diverging for defocusing the beams in the horizontal plane, and the second quadrupole lens being converging for focusing the beams in the horizontal plane.

DETAILED DESCRIPTION OF THE PREFERRED EMBODIMENTS

Figure 1:
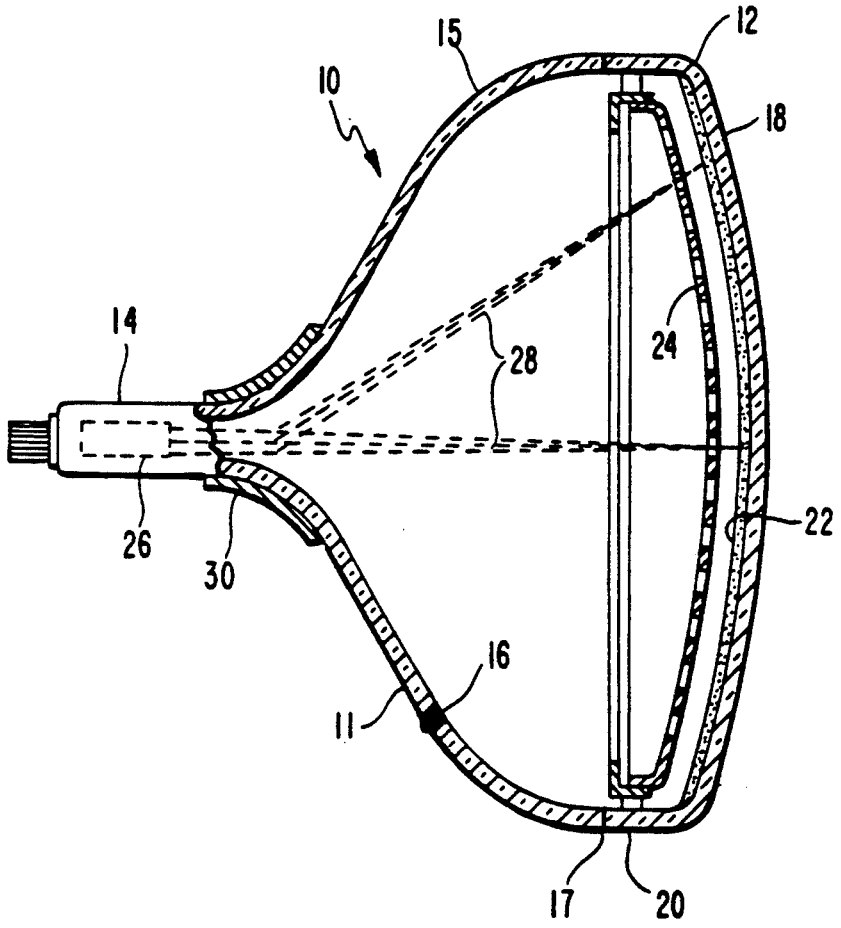
FIG. 1 is a plan view, partly in axial section, of a cathode-ray tube embodying the invention.

FIG. 1 shows a rectangular cathode-ray tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 preferably is a line screen with the phosphor lines arranged in triads, each triad including a phosphor line of each of the three colors. Alternatively, the screen can be a dot screen. A multi-apertured color selection electrode or shadow mask 24 is removably mounted in predetermined spaced relation to the screen 22. The tube includes three axes: a horizontal axis x, a vertical axis y and a longitudinal axis z. An improved electron gun 26, shown schematically by dashed lines in FIG. 1, is centrally mounted within the neck 14 to generate and direct three inline electron beams 28, a center beam and two side or outer beams, along convergent paths through the mask 24 to the screen 22. The three beams 28 initially start in a horizontal plane that includes the x and z axes.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. Preferably, the yoke 30 is one that utilizes saddle-type coil windings, which minimize the penetration of the yoke fields into the electron gun, thereby reducing any deflection experienced by the electron beams before they reach the second quadrupole lens.

Figure 2:
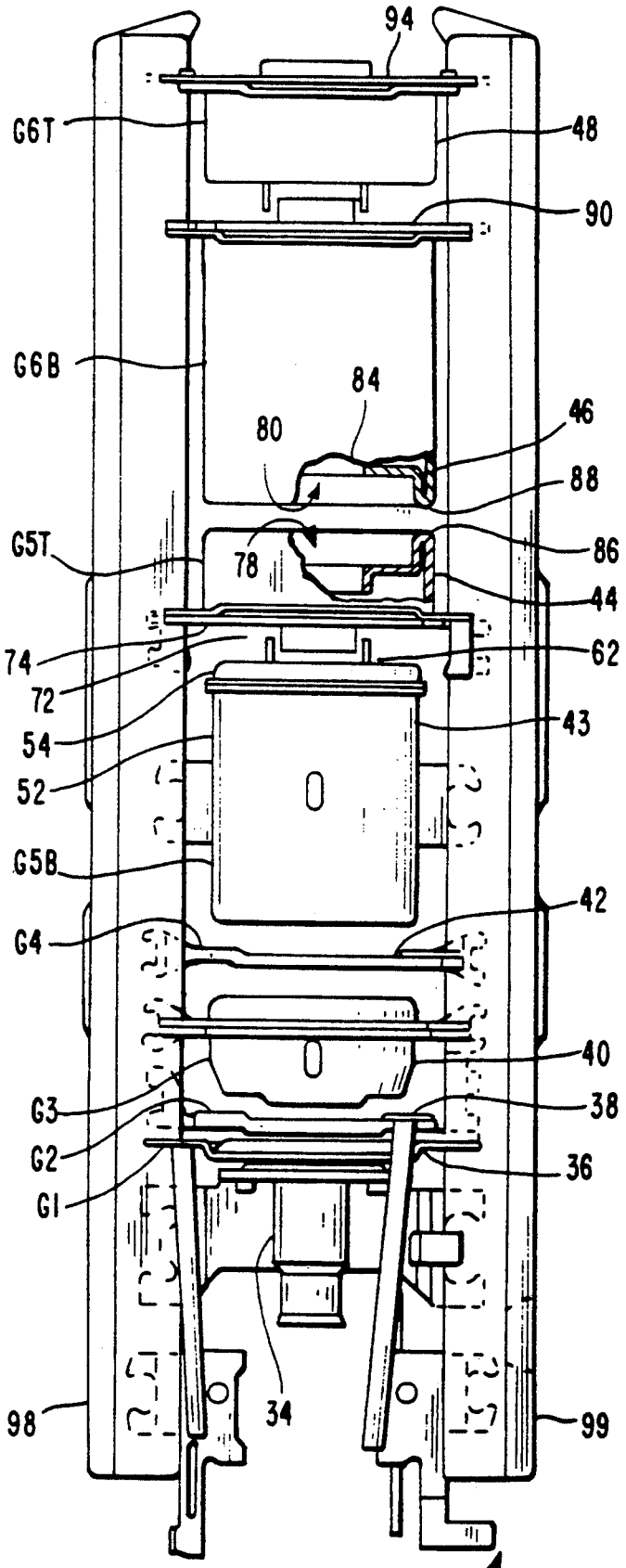
FIG. 2 is a side view, partly in axial cross-section, of an improved electron gun of the tube of FIG. 1.

As shown in FIG. 2, the electron gun 26 comprises three spaced inline cathodes 34 (one for each beam, only one being shown), a control grid electrode 36 (G1), a screen grid electrode 38 (G2), an accelerating electrode 40 (G3), a first focus lens electrode 42 (G4), a first quadrupole electrode 43 (G5B), a combined second quadrupole electrode and first main focusing lens electrode 44 (G5T), a combined third quadrupole electrode and second main focusing lens electrode 46 (G6B), and a fourth quadrupole electrode 48 (G6T), spaced in the order named from the cathodes 34. Each of the G1 through G6T electrodes has three inline apertures therein to permit passage of three electron beams.

The G1 control grid electrode 36 and the G2 screen grid electrode 38 comprise a beam forming region of the electron gun 26. The G3 electrode 40, the G4 first focus lens electrode 42 and the G5B first quadrupole electrode 43 comprise a prefocus lens. The G5B electrode 43 and the G5T combined second quadrupole electrode and first main focusing lens electrode 44 form a first quadrupole lens. The G5T electrode 44 and the G6B combined third quadrupole electrode and second main focusing lens electrode 46 form a main focus lens in the path of each electron beam. The G6B electrode 46 and the G6T fourth quadrupole electrode 48 form a second quadrupole lens.

The G1 control grid 36 and the G2 screen grid 38 are plates that may include reinforcing flutes therein. Each of these grids includes three small inline apertures. The G3 electrode 40 is formed by two cup shaped elements attached to each other at their open ends. The side of the G3 electrode 40 that faces the G2 electrode 38 includes three small inline apertures, and the side of the G3 electrode 40 that faces the G4 electrode 42 includes three larger inline apertures. The G4 electrode 42 is a plate that includes three larger inline apertures.

Figure 3:
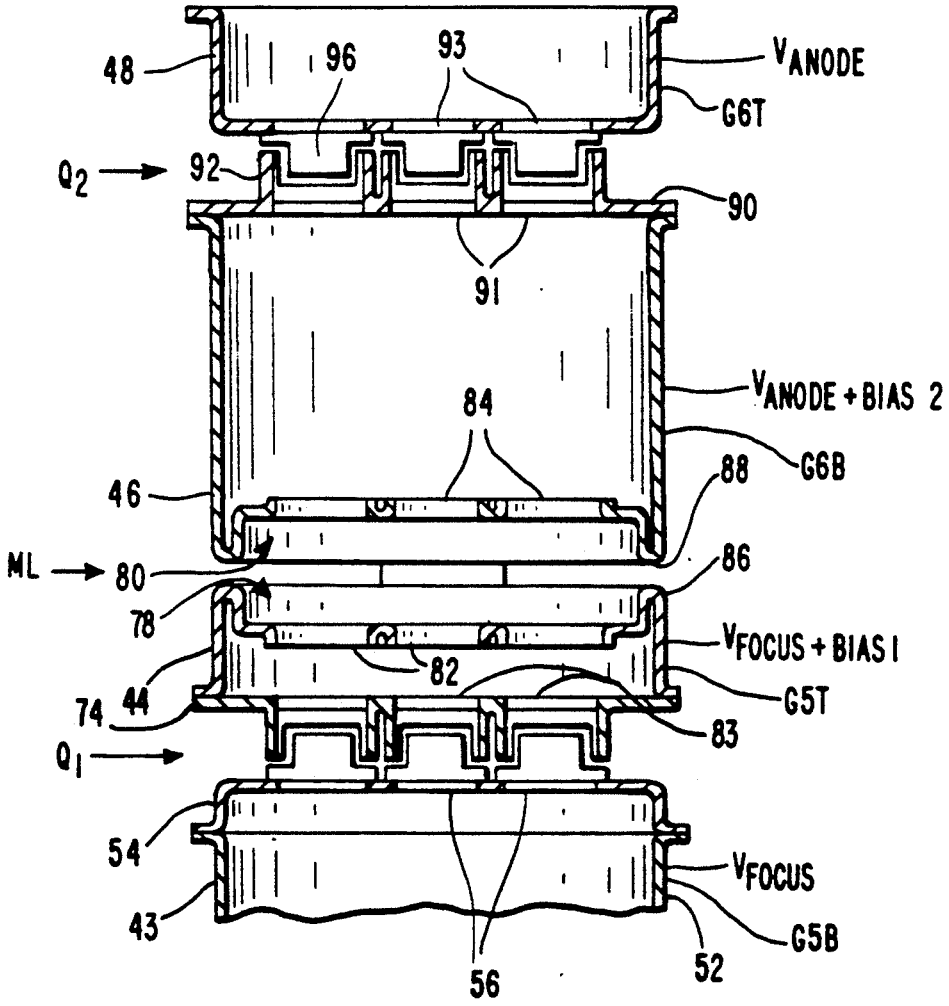
FIG. 3 is a side view, partly in axial cross-section, of a portion of the electron gun of FIG. 2.

As shown in FIGS. 2 and 3, the first quadrupole electrode 43 (G5B) comprises a deep cup-shaped element 52 having its open end closed by an end element 54 that has three inline apertures 56 therein. Extrusions extend from the element 54 in alignment with the apertures. Each extrusion includes two sector portions 62. The two sector portions 62 are located opposite each other, and each sector portion 62 encompasses approximately 85 degrees of the circumference of a cylinder.

The end of the G5T electrode 44 that faces the G5B electrode 43 is closed by a plate 74 that includes three inline apertures 83 therein. Each aperture has extrusions that extend toward the G5B electrode 43. The extrusions of each aperture are formed in two sector portions 72. The two sector portions 72 are located opposite each other, and each sector portion 72 encompasses approximately 85 degrees of a cylinder circumference. The positions of the sector portions 72 are oriented 90° from the positions of the sector portions 62 of the G5B electrode 43, and the four sector portions are assembled in non-touching, interdigitated fashion.

The electrostatic main focusing lens in the electron gun is formed by the facing portions of the G5T electrode 44 and the G6B electrode 46. The facing ends of both the G5T electrode 44 and the G6B electrode 46 include peripheral rims 86 and 88, respectively, and apertured portions set back in large recesses 78 and 80, respectively, from the rims. The apertured portion of the G5T electrode 44 includes three inline apertures 82, and the apertured portion of the G6B electrode 46 includes three inline apertures 84. The rims 86 and 88 are the closest portions of the two electrodes 44 and 46 to each other and have the predominant effect on forming the main focusing lens.

The end of the G6B electrode 46 that faces the G6T electrode 48 is closed by a plate 90 that includes three inline apertures 91 therein. Each aperture has extrusions that extend toward the G6T electrode 48. The extrusions of each aperture are formed in two sector portions 92. The two sector portions 92 are located opposite each other, and each sector portion 92 encompasses approximately 85 degrees of a cylinder circumference.

The G6T electrode 48 is cup-shaped, with the bottom of the cup being apertured and facing the G6B electrode 46 and the open end of the cup being closed by an apertured plate 94. The end of the G6T electrode 48 that faces the G6B electrode 46 includes three inline apertures 93 therein. Each aperture has extrusions that extend toward the G6B electrode 46. The extrusions of each aperture are formed in two sector portions 96. The two sector portions 96 are located opposite each other, and each sector portion 96 encompasses approximately 85 degrees of a cylinder circumference. The positions of the sector portions 96 are oriented 90° from the positions of the sector portions 92 of the G6B electrode 46, and the four sector portions are assembled in non-touching, interdigitated fashion.

All of the electrodes of the gun 26 are either directly or indirectly connected to two insulative support rods 98 and 99. In a preferred embodiment, the support rods are of glass, which has been heated and pressed onto claws extending from the electrodes, to embed the claws in the rods.

Electrical connections to some of the electrodes of the electron gun 26 are shown in FIG. 3. An anode voltage, $V_{ANODE}$, is connected to the G6T electrode 48, and a biased anode voltage, $V_{ANODE+BIAS\,2}$ is applied to the G6B electrode 46. A focus voltage, $V_{FOCUS}$, is applied to the G5B electrode 43, and a biased focus voltage, $V_{FOCUS+BIAS\,1}$ is applied to the G5T electrode 44.

An electron gun constructed in accordance with the present invention overcomes the limitations of the previous electrostatic quadrupole doublets, by placing one or both of the quadrupole lenses on the anode side of the main focus lens. In the electron gun 26, the second quadrupole lens Q2 is located on the anode side of the main lens ML and the first quadrupole lens Q1 is located a short distance before the main focus lens. The smaller distance between the first quadrupole lens Q1 and the main focus lens ML in electron gun 26, compared to the prior art distance between such lenses, reduces the distortion that an electron beam experiences before it reaches the main focus lens. Consequently, the prior art limitation on spot size imposed by the spherical aberration of the main focus lens is avoided. It has been found that the aberrations of the second quadrupole lens Q2 are not a significant limitation on the spot correction that can be achieved with the quadrupole doublet arrangement of the present invention.

The first and second quadrupole lenses, Q1 and Q2, are each formed by a pair of electrodes that produce an astigmatic or quadrupole field when a bias voltage is applied to one of the electrodes. The ability of the two quadrupole lenses to reduce spot growth increases with increases in the bias voltages, which determine the strengths of the two quadrupole lenses Q1 and Q2. The polarities of the two bias voltages are determined by the x-y orientation of the quadrupole electrodes and by the requirement that the beam be defocused by the diverging first quadrupole lens Q1 and focused by the converging second quadrupole lens Q2 in the horizontal (x-z) plane. Both bias voltages may vary with deflection, to achieve optimal spot growth and focus everywhere on the screen. When one of the bias voltages has been selected, the other bias voltage can be set to minimize spot astigmatism.

Figure 4:
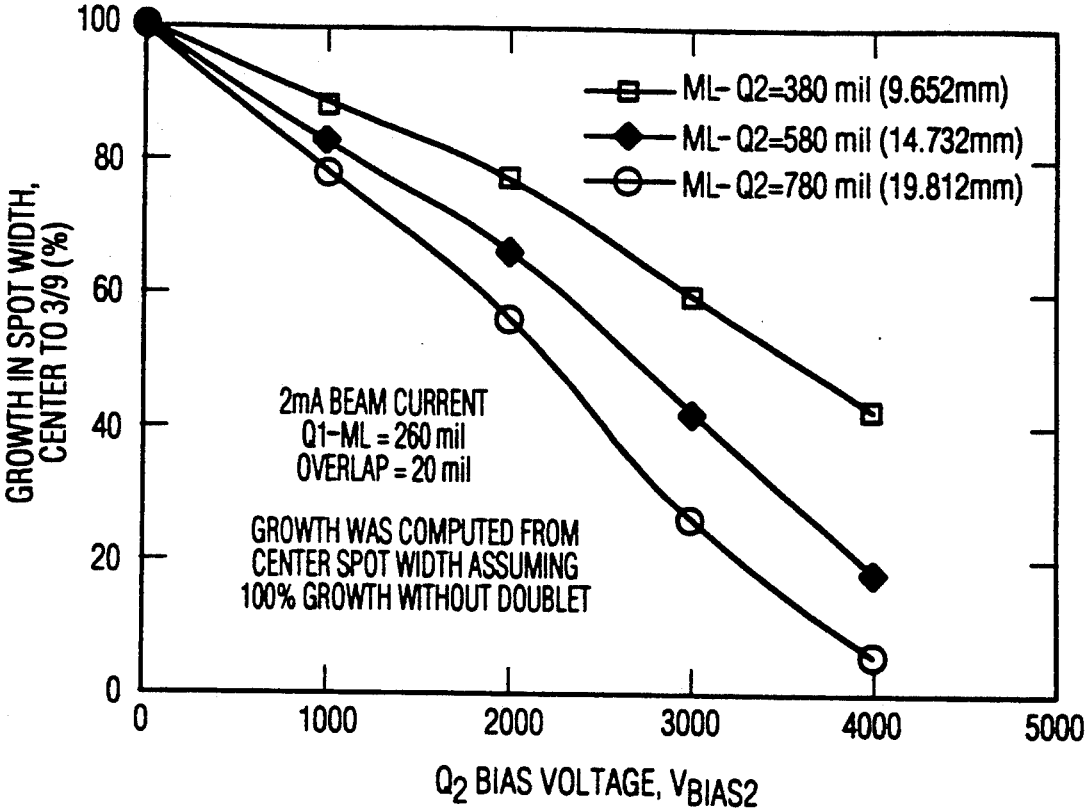
FIG. 4 is a graph of percentage of spot width growth versus bias voltages for different main lens ML to second quadrupole lens Q2 spacings.
Figure 5:
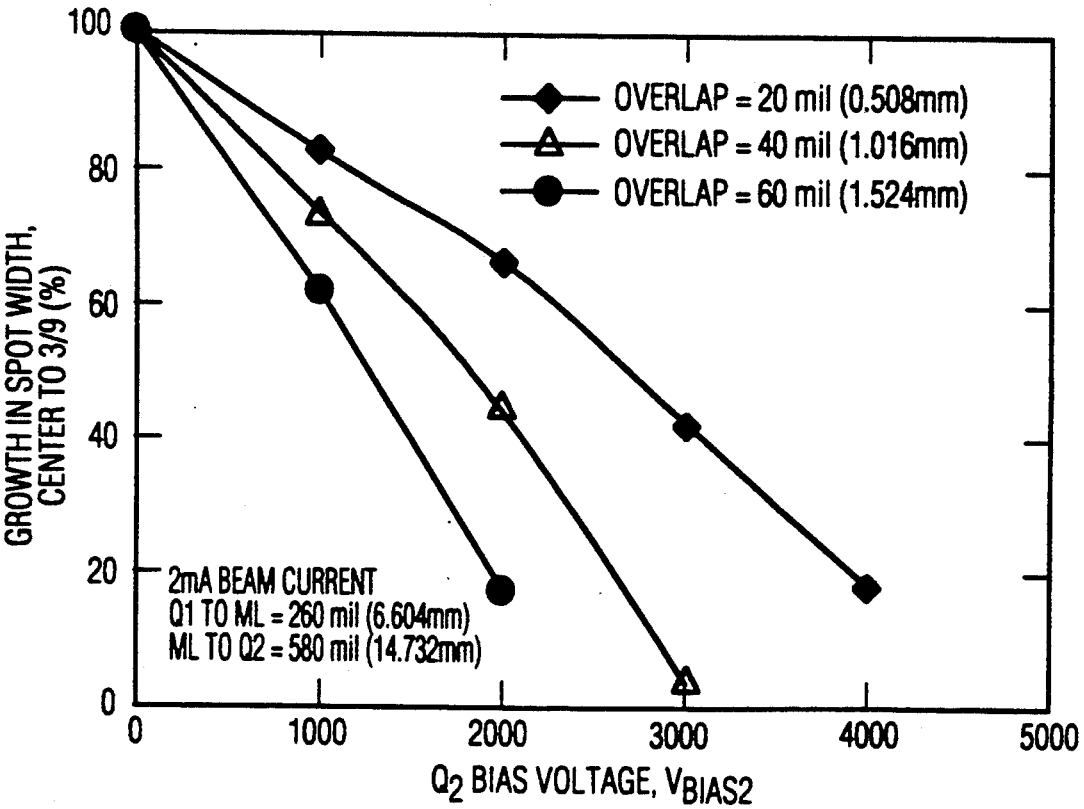
FIG. 5 is a graph of percentage of spot width growth versus bias voltages for different amounts of quadrupole extrusion overlap.

The ability of the two quadrupole lenses, positioned as indicated above in accordance with the present invention, to produce significant reductions in electron beam spot growth, has been verified by computer simulations. The growth in spot width, that can be achieved with the novel placement of quadrupole lenses in an electron gun, is shown in FIGS. 4 and 5 as a function of the second quadrupole lens, Q2, bias voltage $V_{BIAS\ 2}$. The growth shown in FIGS. 4 and 5 was computed from a center spot width assuming 100% growth without a quadrupole doublet. The spot width decreases with increases in the second quadrupole lens Q2 bias voltage $V_{BIAS\ 2}$ and with increases in separation between the second quadrupole lens Q2 and the main focus lens ML, as shown in FIG. 4. Significant reductions in the second bias voltage $V_{BIAS\ 2}$, that are necessary to attain a given amount of spot growth, can be achieved by increasing the amount of overlap of the sector portions that produce the quadrupole field, as shown in FIG. 5.

What is claimed is:

1. In a cathode-ray tube including a viewing screen and an electron gun for generating and directing three electron beams toward said screen, said gun including a plurality of electrodes spaced in order from three cathodes, with the furthest electrode from the cathodes being interconnected to a tube anode, said plurality of electrodes forming a beam forming region, a first quadrupole lens, a main focus lens and a second quadrupole lens in the path of each electron beam, the improvement comprising said first quadrupole lens being located between said beam forming region and said main focus lens, and said second quadrupole lens being located on the anode side of main focus lens, one of the electrodes forming said second quadrupole lens being said furthest electrode from said cathodes, said first quadrupole lens being diverging for defocussing said beams in said horizontal plane, and said second quadrupole lens being converging for focusing said beams in said horizontal plane.

2. A cathode-ray tube as defined in claim 1, including a magnetic deflection yoke that utilizes saddle-type coil windings.

3. In a cathode-ray tube including a viewing screen and an electron gun for generating and directing three electron beams toward said screen, said tube including a horizontal axis, a vertical axis and a longitudinal axis, a horizontal plane of said tube including said horizontal and longitudinal axes, the improvement comprising said gun including at least eight electrodes spaced from three cathodes, said electrodes forming in order from said cathodes a beam forming region, a prefocus lens, a first quadrupole lens, a main focus lens and a second quadrupole lens, said first quadrupole lens being diverging for defocusing said beams in said horizontal plane, and said second quadrupole lens being converging for focusing said beams in said horizontal plane.

4. In a cathode-ray tube including a viewing screen and an electron gun for generating and directing three electron beams toward said screen, said tube including a horizontal axis, a vertical axis and a longitudinal axis, a horizontal plane of said tube including said horizontal and longitudinal axes, the improvement comprising said gun including eight separated electrodes spaced in the order G1, G2, G3, G4, G5B, G5T, G6B and G6T from three cathodes, at least the G1 and G2 electrodes forming a beam forming region of said gun, said G3, G4 and G5B electrodes forming a prefocus lens, said G5B and G5T electrodes forming a first quadrupole lens, said G5T and G6B electrodes forming a main focus lens, and said G6B and G6T electrodes forming a second quadrupole lens, in the path of each electron beam, said first quadrupole lens being diverging for defocusing said beams in said horizontal plane, and said second quadrupole lens being converging for focusing said beams in said horizontal plane.

* * * * *